US006054915A

United States Patent [19]

Rowton et al.

[11] Patent Number: 6,054,915

[45] Date of Patent: Apr. 25, 2000

[54] COMPACT TOUCHSAFE FUSEHOLDER WITH REMOVABLE FUSE CARRIER

[75] Inventors: Daniel Eugene Rowton, Wildwood, Mo.; David R. Marach, Minoqua, Wis.; Sean V. Ciesielka, Mundelein, Ill.

[73] Assignee: Cooper Industries, Inc., Houston, Tex.

[21] Appl. No.: 09/024,221

[22] Filed: Feb. 17, 1998

[51] Int. Cl.[7] ..... H01H 85/20; H01H 85/22

[52] U.S. Cl. ..... 337/216; 337/186; 337/187; 337/189; 337/180

[58] Field of Search ..... 337/186, 187, 337/180, 189, 194, 208, 213, 216; 361/642, 646

[56] References Cited

U.S. PATENT DOCUMENTS

| | | | |
|---|---|---|---|
| 1,522,729 | 1/1925 | Loudon | 337/187 |
| 2,091,204 | 8/1937 | Horn . | |
| 3,189,712 | 6/1965 | Kozacka . | |
| 3,202,788 | 8/1965 | George . | |
| 3,229,066 | 1/1966 | Rowe | 200/133 |
| 3,261,950 | 11/1964 | Kozacka . | |
| 3,261,952 | 7/1966 | Kozacka . | |
| 3,299,066 | 1/1967 | Papesch et al. . | |
| 3,358,100 | 12/1967 | Schleicher | 200/114 |
| 3,538,480 | 11/1970 | Urani | 337/187 |
| 3,671,910 | 6/1972 | Kozacka . | |
| 3,697,916 | 10/1972 | Belcher et al. . | |
| 3,713,064 | 1/1973 | Jacobs, Jr. . | |
| 3,732,516 | 5/1973 | Puetz | 337/194 |
| 3,742,413 | 6/1973 | Taylor | 337/201 |
| 3,764,949 | 10/1973 | Swain . | |
| 3,766,507 | 10/1973 | Jacobs, Jr. . | |
| 3,783,428 | 1/1974 | Swain et al. . | |
| 3,824,520 | 7/1974 | Knapp, Jr. . | |
| 3,935,553 | 1/1976 | Kozacka et al. . | |
| 4,082,408 | 4/1978 | Angelis . | |
| 4,300,281 | 11/1981 | Panaro . | |
| 4,344,058 | 8/1982 | Knapp, Jr. et al. . | |
| 4,365,226 | 12/1982 | Barry et al. . | |
| 4,414,526 | 11/1983 | Panaro . | |
| 4,559,504 | 12/1985 | Krec . | |
| 4,751,489 | 6/1988 | Spaunhorst . | |
| 4,768,968 | 9/1988 | Daggett et al. | 439/246 |
| 4,782,317 | 11/1988 | Thwaites . | |
| 4,949,062 | 8/1990 | Mollet . | |
| 4,949,063 | 8/1990 | Levko . | |
| 4,951,026 | 8/1990 | Ehlmann . | |
| 4,972,170 | 11/1990 | Ehlmann et al. . | |
| 4,992,770 | 2/1991 | Spalding et al. . | |
| 4,994,779 | 2/1991 | Douglass . | |
| 5,002,505 | 3/1991 | Jones et al. . | |
| 5,049,092 | 9/1991 | Takano et al. | 439/540 |
| 5,075,664 | 12/1991 | Spalding et al. . | |
| 5,077,534 | 12/1991 | Douglass . | |
| 5,229,739 | 7/1993 | Oh et al. . | |
| 5,235,306 | 8/1993 | Kalra et al. . | |
| 5,239,291 | 8/1993 | Henricks et al. . | |
| 5,296,832 | 3/1994 | Perreault et al. . | |
| 5,338,228 | 8/1994 | Wright, Jr. et al. | 439/621 |
| 5,357,234 | 10/1994 | Pimpis et al. . | |
| 5,418,515 | 5/1995 | Reyes . | |
| 5,426,411 | 6/1995 | Pimpis et al. . | |

FOREIGN PATENT DOCUMENTS

| | | |
|---|---|---|
| 680901 | 5/1949 | United Kingdom . |

*Primary Examiner*—Leo P. Picard
*Assistant Examiner*—Anatoly Vortman
*Attorney, Agent, or Firm*—Armstrong Teasdale LLP

[57] ABSTRACT

A fuseblock is compact, and electrically conductive components of the fuseblock do not extend beyond a length of a fuse in the fuseblock. The fuseblock can be assembled easily and quickly without tools, and can be easily configured in different ways using the same components. The fuseblock can be snapped onto a mounting rail using mounting projections that are integral with the fuseblock. The fuseblock can include wire end connectors that each have two or more openings for receiving wire ends. The fuseblock also effectively conceals live electrical contacts from accidental touch when the fuseblock is closed and operational, and also when the fuseblock is opened to replace or inspect the fuse, thereby preventing a person servicing the fuseblock from accidentally receiving an electrical shock.

20 Claims, 7 Drawing Sheets

COMPACT TOUCHSAFE FUSEHOLDER WITH REMOVABLE FUSE CARRIER

BACKGROUND OF THE INVENTION

1. Field of the Invention

The invention relates generally to the field of electrical fuseblocks for holding fuses in electrical connection with electrical power sources.

2. Description of Related Art

Conventional fuseblocks, also known as fuseholders, are typically bulky and require an adapter for mounting on a mounting rail such as a DIN rail. They can also be costly, difficult and/or time-consuming to assemble and configure because different parts must typically be used to assemble different configurations and tools are required for many phases of the assembly. In addition, many conventional fuseblocks have live electrical contacts that are exposed in such a way that a person servicing the fuseblock can accidentally receive an electrical shock, for example when the fuse is removed or installed during replacement.

OBJECTS AND SUMMARY

Accordingly, a need exists for a fuseblock that is compact, can be assembled easily and quickly without tools, and can be easily configured in different ways using the same components. A need also exists for a fuseblock that is "touchsafe", i.e., effectively conceals live electrical contacts from accidental touch when the fuseblock is closed and operational, and also when the fuseblock is opened to replace or inspect the fuse, thereby preventing a person handling the fuseblock from accidentally receiving an electrical shock.

An exemplary embodiment of a fuseblock according to the present invention satisfies this need by providing a fuseblock assembly that is compact, touchsafe, can be easily and quickly assembled without tools, and is easily configurable in different ways without requiring different components. All components of the fuseblock snap and lock together. Live electrical contacts are shielded from accidental touch to prevent a person from accidentally receiving an electrical shock when the fuseblock is closed and in operation, and also when the fuseblock is open for inspection or replacement of the fuse. Electrical contacts within the fuseblock assembly are also located directly below the fuse ferrules, thus reducing the amount of mounting surface area, or "footprint", required by the fuseblock.

Additional features and advantages of the invention will become apparent from the following description of the preferred embodiments, taken in conjunction with the accompanying drawings. The accompanying drawings illustrate, by way of example, the principles of the invention.

DETAILED DESCRIPTION OF THE PREFERRED EMBODIMENTS

Figure 1:
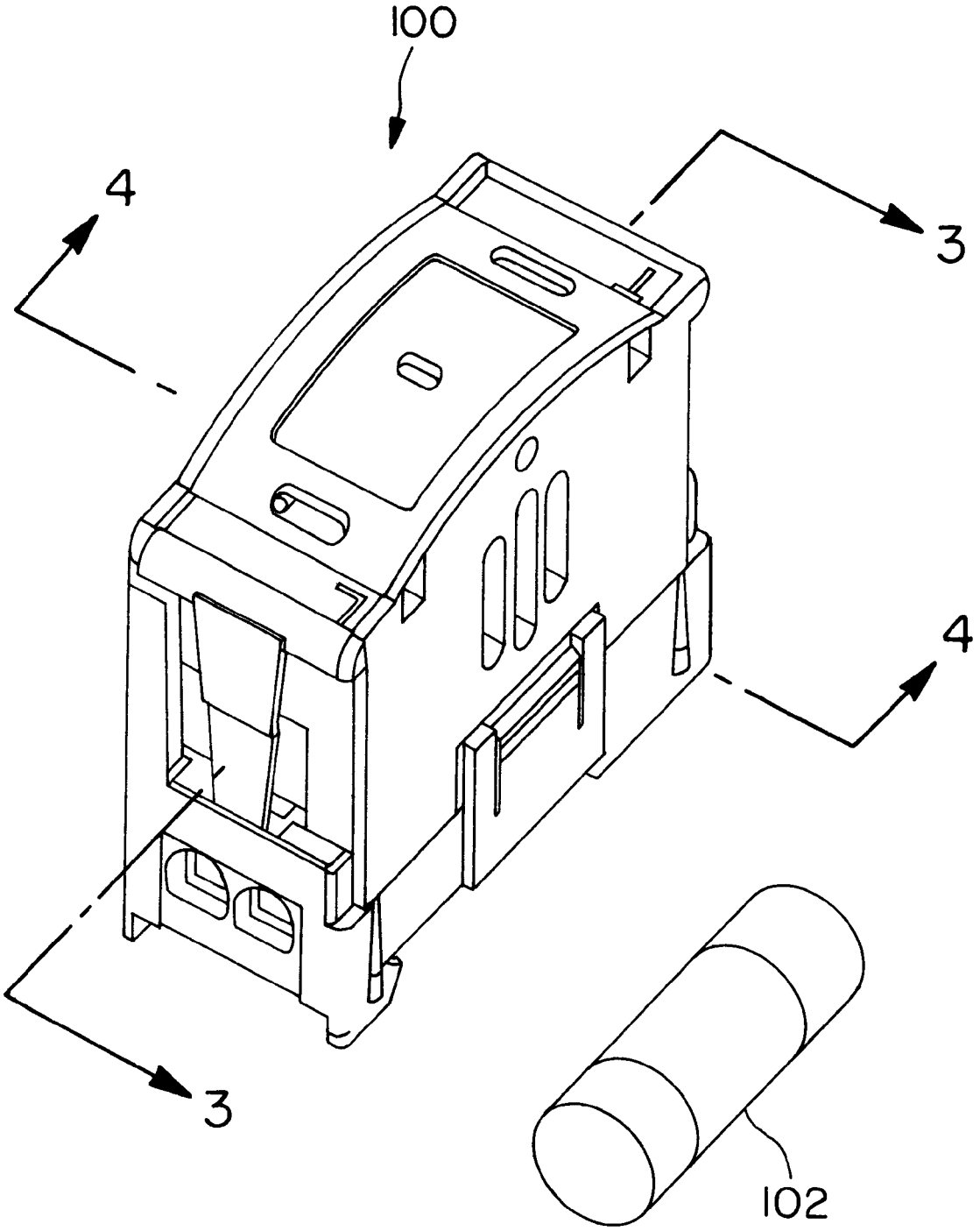
FIG. 1 is a perspective view of an assembled fuseblock according to a first embodiment of the invention.
Figure 2:
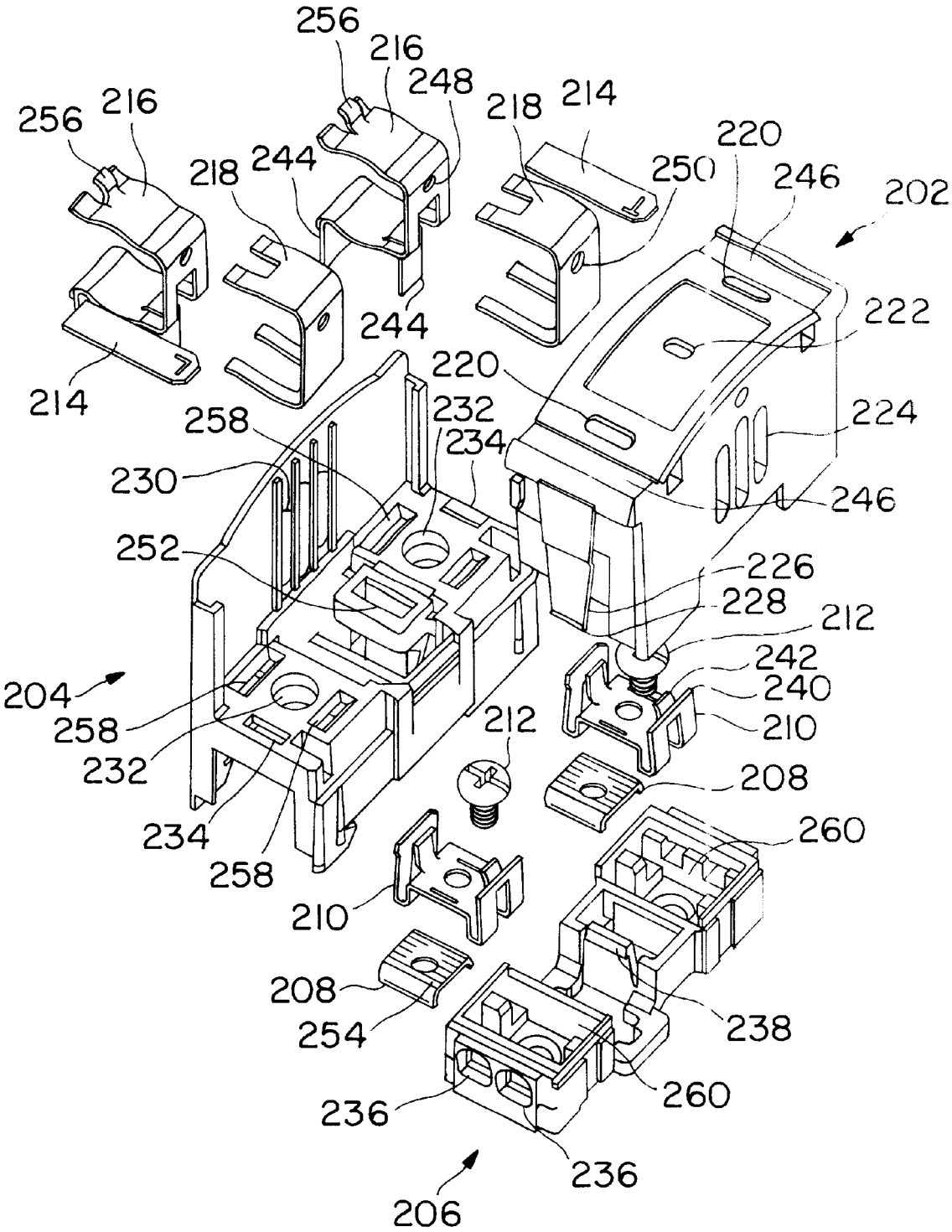
FIG. 2 is an exploded perspective view of the fuseblock of FIG. 1.
Figure 3:
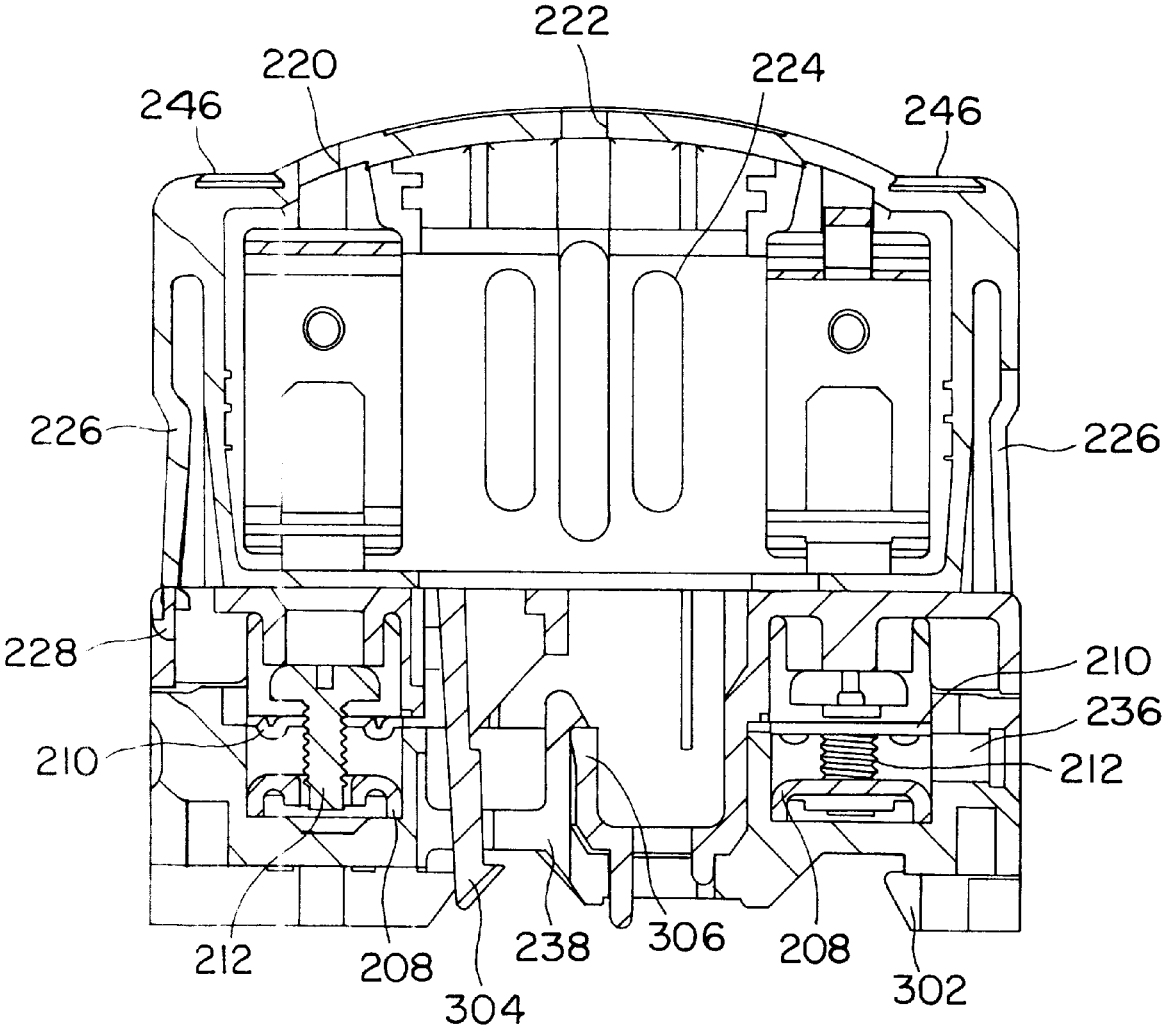
FIG. 3 is a sectional view of the fuseblock of FIG. 1, along the lines 3—3.

FIG. 1 shows a perspective view of an assembled fuseblock 100 according to a first preferred embodiment of the invention. FIG. 1 also shows a perspective view of an exemplary cylindrical fuse 102 that can be used with fuseblock 100. The fuseblock 100 houses a conventional cylindrical fuse (not shown) having two electrical contact ferrules, one at each end of the cylinder. The fuse can have a conventional current carrying capacity, such as 30 Amperes. However, the fuse may have other ampere ratings. FIG. 2 shows an exploded perspective view of the fuseblock 100. A fuseblock base bottom 206 snaps into a fuseblock base shell 204, and a fuse carrier 202 snaps into place on the fuseblock base shell 204. The fuse carrier 202 is four-sided, with a partial fifth side and no sixth side, thus providing access to install and remove fuses in the fuse carrier 202. The partial fifth side provides an opening to install fuse clips and the partial structure provides support for fuse clip assemblies. The fuse carrier 202 contains the fuse and can be removed to inspect or replace the fuse. Fuse carrier locking tabs 226 on each end of the fuse carrier 202 fit into locking recesses 234 in the fuseblock base shell 204, and locking teeth 228 on the fuse carrier locking tabs 226 fit into grooves (not shown) in the fuseblock base shell 204 when fully inserted and lock the fuse carrier 202 and fuseblock base shell 204 together, as shown in FIG. 3. The fuse carrier 202, the fuseblock base shell 204 and the fuseblock base bottom 206 together provide a six-sided housing that completely surrounds the fuse and renders the structure touch-safe. The fuse carrier 202 and the fuseblock base shell 204 can be separated by pressing the fuse carrier locking tabs 226 inwardly, thus disengaging the locking teeth 228 from the grooves in the fuseblock base shell 204 and allowing the fuse carrier locking tabs 226 to be withdrawn from the locking recesses 234.

Fuse clip electrodes 216 and fuse clip springs 218 fit inside the fuse carrier 202, and together secure and electrically contact ferrules of the fuse. The fuse clip springs 218 partially surround the fuse clip electrodes 216, and the fuse clip electrodes 216 partially surround and contact the fuse ferrules. Typically, ductile metals conduct electricity more effectively than elastic metals. When a single material is used to both conduct electricity and provide spring pressure, a compromise is made between conductivity and elasticity. Since the fuse clip springs 218 provide some or all of the spring pressure necessary to secure the fuse ferrules in the fuse clip electrodes 216, and since the fuse clip electrodes 216 conduct electricity that passes through the fuse, the fuse clip spring 218 is preferably formed of a material having good elasticity, and the fuse clip electrode 216 is preferably formed of a material having good conductivity. Thus, the fuse clip electrode 216 and fuse clip spring 218 together form an assembly that has both excellent elasticity and excellent conductivity. This feature can be especially desirable when the fuseblock 100 is subjected to high or fluctuating temperatures.

Figure 4:
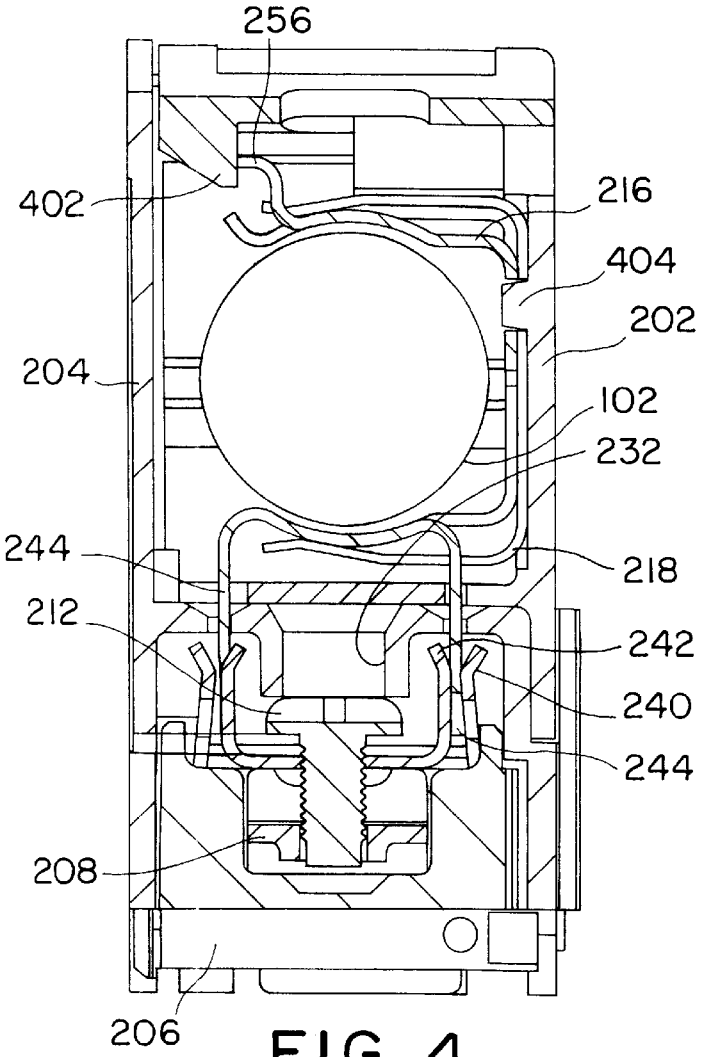
FIG. 4 is a sectional view of the fuseblock of FIG. 1, along the lines 4—4.
Figure 5:
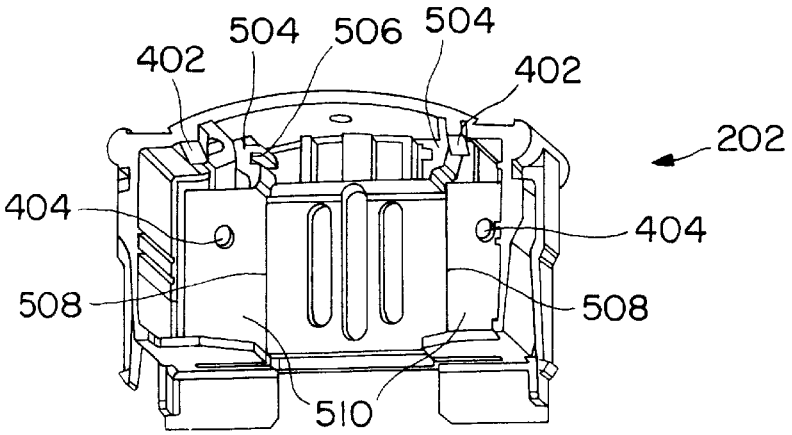
FIG. 5 is a perspective view of a fuse carrier of the fuseblock of FIG. 1.
Figure 9A:
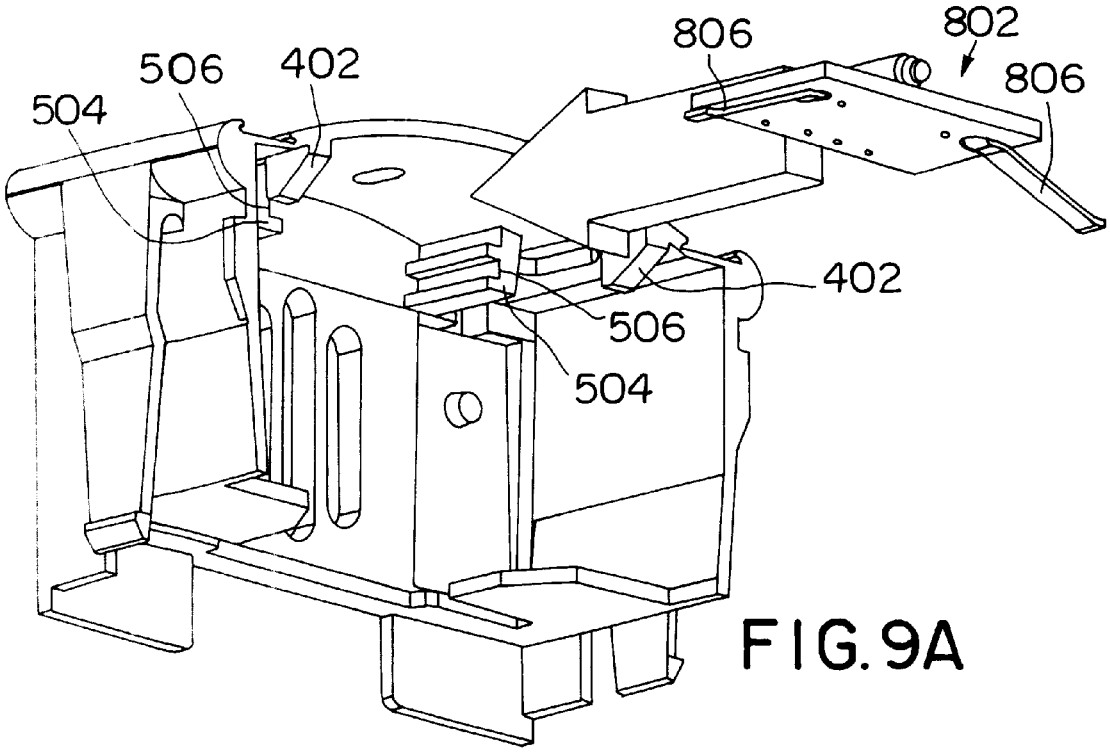
FIG. 9A shows installation of the fuse indicator of FIG. 8 in the fuse carrier of FIG. 5.
Figure 9B:
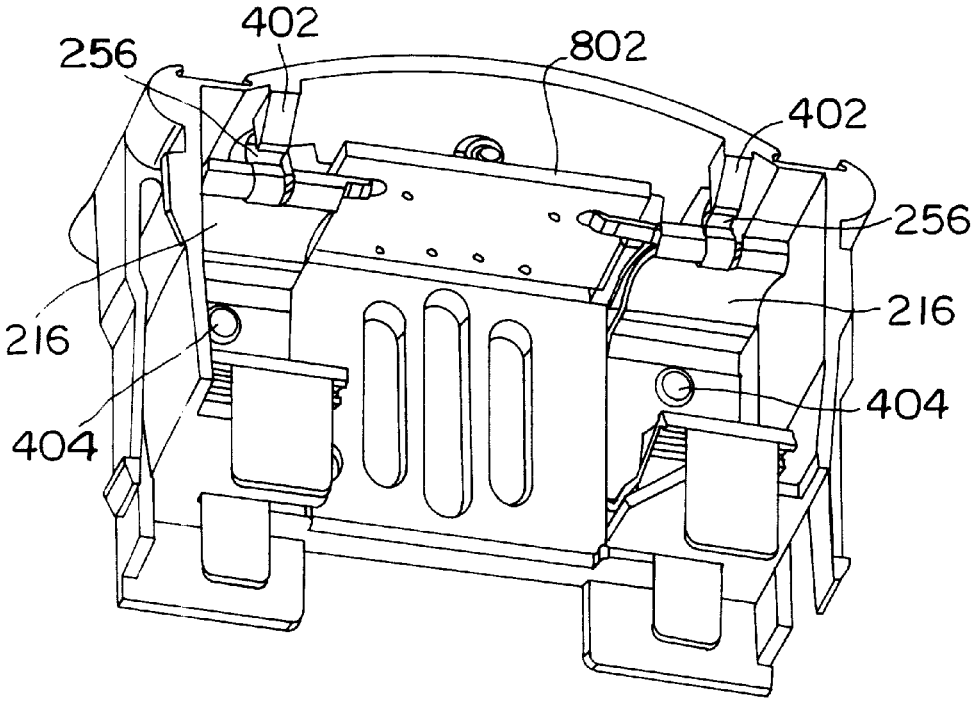
FIG. 9B is a perspective view of the fuse carrier of FIG. 5, with the fuse indicator of FIG. 8 installed.

As shown in FIG. 2, the fuse clip electrode 216 has an alignment hole 248 and the fuse clip spring 218 has an alignment hole 250. An interior surface of the fuse carrier 202 is provided with pockets 510 and alignment nubs 404, as shown in FIGS. 4 and 5. The alignment holes 248 and 250 fit over the respective alignment nubs 404 to position the fuse clip electrode 216 and the fuse clip spring 218 in the fuse carrier 202, as shown in FIGS. 4 and 9B. The alignment nubs 404 are smaller than the alignment holes 248 and 250, and the pockets 510 are larger than the fuse clip electrodes 216 and the fuse clip springs 218. These differences in size allow the fuse clip electrodes 216 and the fuse clip springs 218 to move or "float" with respect to the fuse carrier 202, so that each set of fuse clip electrodes 216 and fuse clip springs 218 will automatically come into alignment when a fuse is installed in the fuse carrier 202. In essence, each fuse clip electrode 216 and fuse clip spring 218 pair is nestled within an oversized pocket 510 wherein a nub 404 provides a general axis of rotation, and edges of the pocket such as the vertical shoulder 508 bound lateral and rotational movement of the fuse clip pair. This configuration simplifies fuseblock assembly and fuse installation, and avoids manufacturing costs associated with providing fixed-position fuse clip assemblies that are adequately aligned. In addition, the fuse clip electrode 216 is provided with a fuse clip retaining flange 256. When the fuse clip electrode 216 and the fuse clip spring 218 are snapped or pressed into place within the fuse carrier 202, the fuse clip retaining flange 256 retains the fuse clip electrode 216 and fuse clip spring 218 within the fuse carrier 202 by pressing against a fuse clip retaining shoulder 402 of the fuse carrier 202, as shown in FIG. 4. FIG. 4 also shows an end view of the cylindrical fuse 102 held by the fuse clip electrodes 216.

The fuse carrier 202 has label slots 246 into which labels 214 are inserted, so that connections to the fuseblock 100 can be easily identified. As shown in FIG. 3, the label slot 246 is a dovetail slot that can secure the label 214 without adhesive. The label slot 246 can be configured in different ways to retain the label 214, and/or adhesive can be used to secure the label 214 within the label slot 246.

The fuseblock base shell 204 has blade slots 258 for receiving fuse carrier contact blades 244 of the fuse clip electrodes 216 mounted in the fuse carrier 202. The fuseblock base shell 204 also has fuseblock base vents 230 for allowing airflow through the interior of the fuseblock 100. The fuseblock base bottom 206 has a fuseblock base bottom locking tab 238 that locks the fuseblock base bottom 206 together with the fuseblock base shell 204 when the fuseblock base shell 204 and the fuseblock base bottom 206 are pressed together, providing a touch-safe housing for live electrical components. As shown in FIG. 3, the fuseblock base bottom locking tab 238 presses against a locking shoulder 306 of the fuseblock base shell 204, and locks the fuseblock base shell 204 and the fuseblock base bottom 206 together. A tool such as a screwdriver can be used to press the fuseblock base bottom locking tab 238 away from the locking shoulder 306 to disengage the fuseblock base shell 204 and the fuseblock base bottom 206.

The fuseblock base bottom 206 houses a lower clamp member 208, upper clamp member 210 and clamp screw 212 which together form a power connection assembly, i.e., a clamp assembly for clamping wire ends inserted through wire ports 236 formed in the fuseblock base bottom 206. The clamp assembly secures the wire ends and provides electrical connections between the wire ends and the cylindrical fuse in the fuseblock 100. Preferably, a wire clamp recess 260 in the fuseblock base bottom 206 is dimensioned to easily receive the upper clamp member 210. The lower clamp member 208 is threaded to receive the clamp screw 212, so that when the clamp screw 212 is tightened, the lower clamp member 208 is drawn toward the upper clamp member 210 and wire ends inserted through the wire port 236 and between the lower clamp member 208 and upper clamp member 210 on either side of the clamp screw 212 are clamped between the lower clamp member 208 and the upper clamp member 210. The lower clamp member 208 can be provided with ridges 254 to grip the wire ends. Alternatively or additionally, the upper clamp member 210 can be provided with ridges (not shown) to grip the wire ends. The fuseblock base shell 204 is provided with wire connect adjustment ports 232, so that when a fuse carrier 202 is removed from a mounted and assembled fuseblock 100, a tool such as a screwdriver can be inserted through the wire connect adjustment port 232 to access the clamp screw 212 and clamp or unclamp wire ends inserted through the wire ports 236.

Since two wire ports 236 are provided at each end of the fuseblock 100, multiple fuseblocks 100 can be easily arranged in a daisy chain configuration. For example, two wires can be electrically connected to one end of a first fuseblock 100, where one of the wires connects the first fuseblock 100 to a power source or ground and the other wire connects to a second fuseblock 100, thus connecting the second fuseblock 100 to the same power source or ground.

The upper clamp member 210 is trifurcated to provide an inner electrical contact 240 and an outer electrical contact 242. When the fuse carrier 202 is inserted into the fuseblock base shell 204, the fuse carrier contact blades 244 of the fuse clip electrode 216 mounted in the fuse carrier 202 extend through the blade slots 258 of the fuseblock base shell 204 and between the inner electrical contacts 240 and outer electrical contacts 242 of the upper clamp member 210, which receive the fuse carrier contact blades 244 and form an electrical connection as shown in FIG. 4. The trifurcated configuration improves overall performance of the fuseblock 100 by providing a generous amount of electrical contact area between the fuse carrier contact blade 244 and the electrical contacts 240 and 242, thus enhancing an amount of current that can be conducted to and from the fuse. The trifurcated configuration also properly aligns the fuse carrier contact blades 244 in contact with the upper clamp member 210. Each fuse clip electrode 216 is preferably provided with two fuse carrier contact blades 244, thereby increasing the electrical contact surface area to further enhance the current carrying capacity of the fuse block 100.

As shown in FIG. 3, the fuseblock base shell 204 is provided with a movable DIN rail engagement flange 304 and a fixed DIN rail engagement flange 302. These flanges 304 and 302 are integral with the fuseblock base shell 204. For example, the fuseblock base shell 204 can be a single piece of plastic that includes the movable DIN rail engagement flange 304 and the fixed DIN rail engagement flange 302. The fuseblock 100 can be mounted on a DIN rail (not shown) by slipping the fuseblock 100 over an end of the DIN rail so that the fixed DIN rail engagement flange 302 and the movable DIN rail engagement flange 304 engage the edges of the DIN rail. Alternatively, the fuseblock 100 can be snapped onto the DIN rail by fitting one edge of the DIN rail behind the fixed DIN rail engagement flange 302, and then rotating the fuseblock 100 toward the DIN rail so that the other edge of the DIN rail deflects the movable DIN rail engagement flange 304 and then snaps into place behind it. A tool such as a screwdriver can be inserted through the DIN rail release guide slot 252 in the fuse carrier 202 to press the movable DIN rail engagement flange 304 away from the edge of the DIN rail to disengage the fuseblock 100 from the DIN rail.

The fuse carrier 202 is provided with probe holes 220 to allow insertion of electrical probes into the fuseblock 100 to monitor electrical conditions at the fuse clip electrodes 216. The fuseblock base vents 230 in the fuseblock base shell 204 and the fuse carrier vent 224 in the fuse carrier 202 are also arranged so that when two or more fuseblocks 100 are mounted side by side immediately adjacent each other, as for example on a DIN rail, the fuseblock base vents 230 of one fuseblock 100 are aligned with the fuse carrier vents 224 of an adjacent fuseblock 100 to allow airflow between and through the fuseblocks 100. Thus, multiple fuseblocks 100 can be mounted closely together in a compact group configuration that minimizes a total necessary footprint without comprising airflow through the fuseblocks 100.

Figure 8:
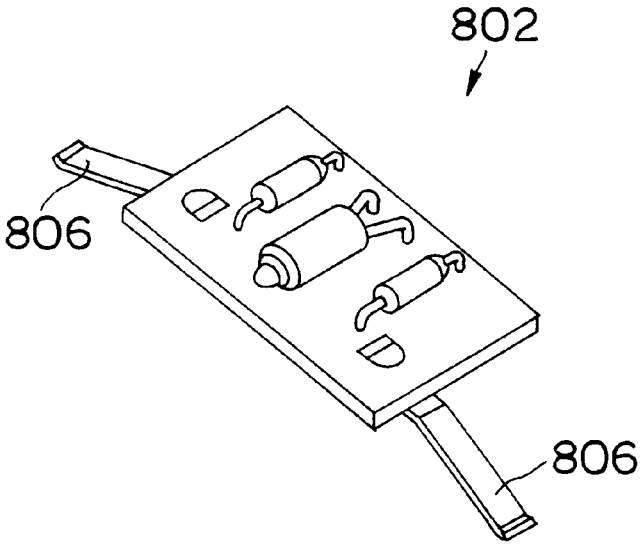
FIG. 8 is a perspective view of a fuse indicator.

The fuse carrier 202 can also be provided with a fuse indicator viewport 222 for viewing a fuse indicator which shows if the fuse has opened and a voltage exists between the fuse clip electrodes 216. For example, the fuse indicator can include a neon lamp which is lit when the fuse is open and there is a voltage across the fuse clip electrodes. As shown in FIG. 5, the fuse carrier 202 is provided with retaining shoulders 504, each having a slot 506 for receiving and supporting a fuse indicator. FIG. 8 shows an exemplary fuse indicator 802, complete with electrical contacts 806. As shown in FIG. 9A, the fuse indicator 802 can be inserted into the slots 506 of the retaining shoulders 504. Then, as shown in FIG. 9B, after the fuse clip electrodes 216 and the fuse clip springs 218 have been inserted and snapped into place within the fuse carrier 202, the electrical contacts 806 of the fuse indicator 802 press against the fuse clip springs 218. The fuse clip retaining flanges 256 retain the fuse indicator 802 by preventing the fuse indicator 802 from sliding out of the slot 506. Thus, a single wall of the fuse carrier 202 supports and secures both the fuse clip electrode 216 and fuse clip spring 218 as well as the fuse indicator 802, via the fuse clip retaining shoulder 402 and the retaining shoulder 504 together with the slot 506.

Figure 6A:
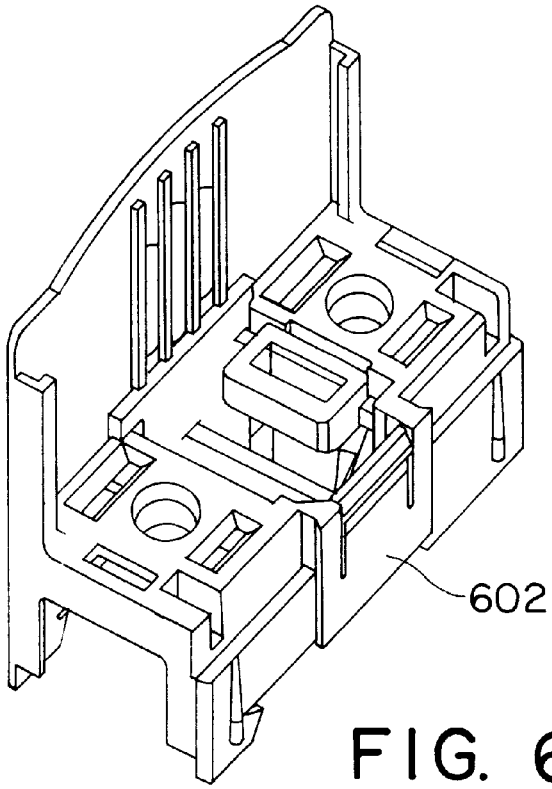
FIGS. 6A & 6B are perspective views of a base shell of the fuseblock of FIG. 1.
Figure 6B:
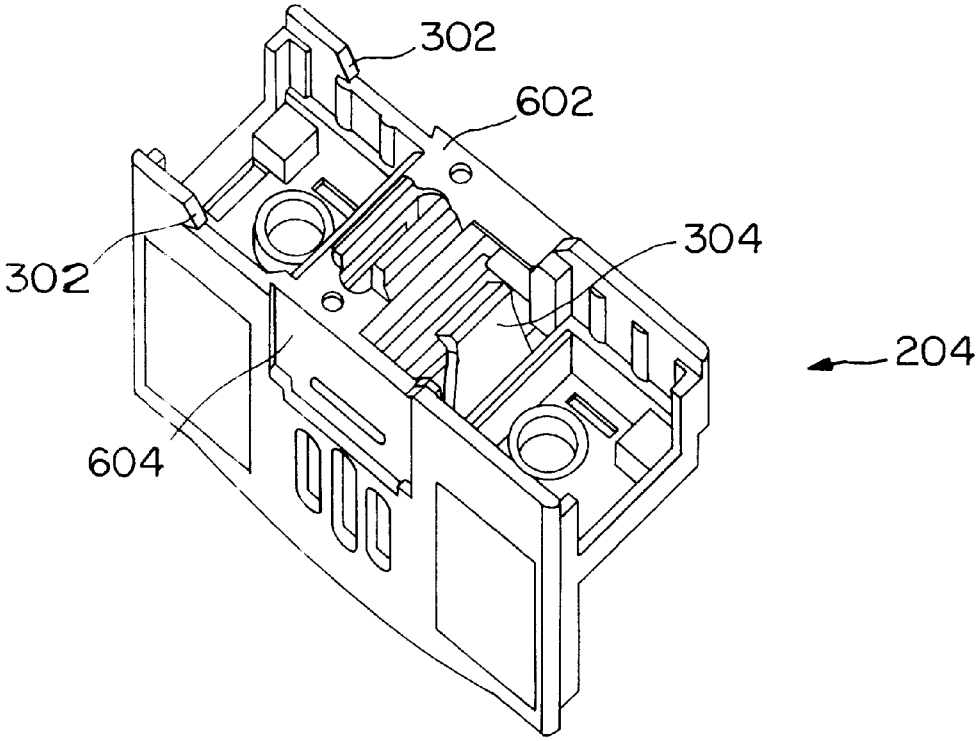
Figure 7:
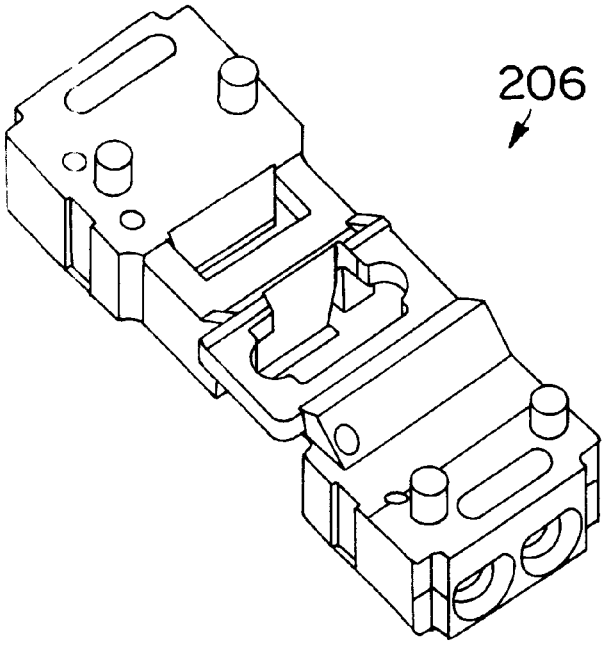
FIG. 7 is a perspective view of a base bottom of the fuseblock of FIG. 1.

The fuseblock 100 also has a dovetail 602 and a dovetail slot 604 as shown in FIGS. 6A and 6B. The dovetail 602 and dovetail slot 604 are appropriately dimensioned and located so that multiple fuseblocks 100 can be fastened or "ganged" together, with the dovetail 602 of one fuseblock 100 interlocking with the dovetail slot 604 of an adjacent fuseblock 100. When multiple fuseblocks 100 are ganged, the fuseblock base vents 230 and fuse carrier vents 224 of adjacent fuseblocks 100 are aligned as described above so that air can flow through and between adjacent fuseblocks 100.

The fuseblock base bottom 206 preferably has a color that is lighter than that of the fuseblock base shell 204, to help a person locate the wire ports 236 in low-light conditions, such as in a poorly lit electrical panel. For example, the fuseblock base bottom 206 can be white, and the fuseblock base shell 204 can be black.

The wire end clamping components including the lower clamp member 208, upper clamp member 210 and clamp screw 212, and the fuse clip electrode 216 and fuse clip spring 218 are located adjacent to fuse ferrules of a fuse mounted in the fuse carrier 202, as shown for example in FIGS. 3 and 4, and do not extend substantially beyond the length of the fuse. This allows the fuseblock 100 to be compact and have a minimal footprint.

As shown in FIGS. 1 and 2, the fuseblock 100 is touchsafe because all of the electrically conductive components are effectively enclosed and shielded from a person's touch. In particular, the fuse carrier 202, fuseblock base shell 204 and fuseblock base bottom 206 are constructed of materials that are electrical insulators, such as thermoplastic. The fuse carrier 202, fuseblock base shell 204 and fuseblock base bottom 206 enclose the wire clamp assembly and the fuse clip electrodes 216 and the fuse clip springs 218, with the exception of the probe holes 220 and the wire connect adjustment ports 232. Preferably, the probe holes 220 and the wire connect adjustment ports 232 are large enough to receive tools such as an electrical probe or a screwdriver, but are small enough to prevent a person's fingers from touching electrically conductive fuseblock components that are attached to a power source, regardless of whether the fuse carrier 202 is detached from or locked into the fuseblock 100. The walls of the fuse carrier 202 and the fuseblock base shell 204 are also arranged so that a person will not receive an electric shock when inserting or locking the fuse carrier 202 into the fuseblock 100. When the fuse carrier contact blades 244 have just begun to contact the upper clamp member 210 before the fuse carrier locking tabs 226 lock into the locking recesses 234 but are not fully inserted, gaps between the fuse carrier 202 and the fuseblock base shell 204 are too small for a person's fingers to pass through and touch any components that might convey an electric shock, for example the fuse carrier contact blades 244.

The invention can be optimized for use with other fuses having different configurations and/or performance characteristics from the fuse described above, which has a cylindrical shape and electrical contact ferrules at its ends. In addition, the number and size of the wire ports in each fuseblock can be varied to accommodate wires having a minimum necessary size that corresponds to a desired overall size and current carrying capacity of the fuseblock. Where a large current carrying capacity is desired and the wire ports must be large to accommodate wires that are large to adequately handle current, small overall size of the fuseblock may be more important than flexibility provided by multiple wire ports. Consequently, the fuseblock can be provided with a minimum number of wireports to maintain a compact size. In addition, the wire ports can be oriented at different angles with respect to the the fuseblock. Furthermore, even when the fuseblock is scaled up to such a degree that wire ports and/or wire connect adjustment ports are large enough to permit a person to insert a finger and contact electrically conductive components, the fuseblock can still be configured to prevent the person from accidentally receiving an electrical shock. For example, only a single wire port can be provided at each end of the fuseblock, so that there is no power supplied to the fuseblock when one or more of the wire ports is empty. If in addition, the wire ports are sized so that either a finger or a wire end can fit into a wire port, but not both at the same time, then a person is not likely to receive an electric shock from touching the wire port. The fuseblock can still remain touchsafe in the situation where a wire port can be both empty and connected to a power source, or when the wire connect adjustment ports are large enough to permit a finger to enter, because the wire ports and the adjustment ports are located away from areas a person would normally touch when servicing or inspecting the fuseblock. As an additional safety measure, electrical components of the fuseblock can be located deeper within the wire ports and adjustment ports or the ports can be extended, so that a person who accidentally touches outer portions of the wire ports and adjustment ports will not reach deeply enough to contact live electric components.

Accordingly, although the invention has been described in detail with reference only to presently preferred embodiments, those skilled in the art will appreciate that various modifications can be made without departing from the spirit and intended scope of the invention.

What is claimed is:

1. A fuseblock, comprising:

a fuseblock base bottom constructed of electrical insulating material and including two laterally displaced cavities for receiving and securing first and second means for making electrical connections with wire ends;

a fuseblock base shell having a top and first and second noncontiguous side walls extending from the top, wherein the first side wall extends from the top in a first direction, a first portion of the second side wall extends from the top in the first direction, and a second portion of the second side wall extends from the top in a second direction opposite the first direction, the first side wall, and the top and the first portion of the second side wall define a laterally extending recess for receiving the fuseblock base bottom;

a fuse carrier having a top, a side wall extending from the top, two end walls contiguous with the top and the side wall, first and second laterally displaced fuse clips each including at least one vertically extending member, and means for locating and securing the first and second laterally displaced fuse clips; wherein the fuse carrier interacts with the fuseblock base shell to form a six-sided enclosure defined by the top, side wall and end walls of the fuse carrier and the top and second portion of the second side wall of the fuseblock base shell, and each at least one vertically extending fuse clip member passes through the fuseblock base shell top and electrically contacts one of the first and second electrical connection means.

2. The fuseblock of claim 1, wherein the fuse carrier includes apertures for providing probe access to the fuse clips.

3. The fuseblock of claim 1, wherein the fuseblock base shell includes an integral fixed projection and an integral flexible projection for together grasping a mounting rail, and an aperture for receiving a tool to displace the integral flexible projection and release the mounting rail.

4. The fuseblock of claim 1, wherein the fuseblock base shell and the fuse carrier each have vents so that when multiple fuseblocks are linked together by at least one of a mounting rail and interlocking dovetails and dovetail slots, the vents in the linked fuseblocks are aligned.

5. The fuseblock of claim 1, wherein the fuseblock base shell further comprises a dovetail on one side and a matching dovetail slot on the other side.

6. The fuseblock of claim 1, wherein the fuse clip includes a hole and a flange and an interior surface of the fuse carrier includes a nub and a shoulder and the nub fits in the hole and the flange fits behind the shoulder to lock the fuse clip and the fuse carrier together.

7. The fuseblock of claim 1, further comprising a fuse status indicator supported by an interior surface of the fuse carrier and retained between the fuse clip and the fuse carrier when the fuse clip is locked together with the fuse carrier, and at least one aperture in the fuse carrier for providing visual access to the fuse status indicator.

8. The fuseblock of claim 1, wherein a color of the fuseblock base bottom contrasts with a color of the fuseblock base shell.

9. The fuseblock of claim 1, wherein the fuse carrier and the fuseblock base shell are releasably fastened together by at least one integral and flexible locking member provided in one of the fuse carrier and the fuseblock base shell and at least one corresponding rigid locking surface provided in the other of the fuse carrier and the fuseblock base shell.

10. The fuseblock of claim 1, wherein the fuseblock base bottom and the fuseblock base shell are releasably fastened together by at least one integral and flexible locking member provided in one of the fuseblock base bottom and the fuseblock base shell and at least one corresponding rigid locking surface provided in the other of the fuseblock base bottom and the fuseblock base shell.

11. The fuseblock of claim 1, wherein:

each fuse clip has an opening;

the means for locating and securing the first and second laterally displaced fuse clips includes a pocket and a nub within the pocket for each fuse clip;

the fuse clip is located within the pocket;

the nub protrudes through the opening;

the pocket is larger than the fuse clip;

the fuse clip can move rotationally about the nub and laterally within the pocket;

at least one of contact between the opening and the nub and contact between an edge of the fuse clip and an edge of the pocket limits lateral movement of the fuse clip within the pocket; and contact between an edge of the fuse clip and an edge of the pocket limits rotational movement of the fuse clip within the pocket.

12. The fuseblock of claim 1, wherein:

the first and second electrical connection means receive wire ends and electrically connect the received wire ends with the first and second fuse clips; and the first and second fuse clips form a first axis, the first and second electrical connection means form a second axis, the first and second axes are substantially coplanar, and the first and second electrical connection means lie between third and fourth axes that intersect the first axis at the first and second electrical connection means respectively and are perpendicular to the first axis.

13. The fuseblock of claim 1, wherein each of the first and second electrical connection means includes two or more openings for receiving wire ends.

14. A fuseblock, comprising:

a fuse carrier having a pocket and a nub within the pocket; and at least one fuse clip having an opening; wherein the fuse clip is located within the pocket;

the nub protrudes through the opening;

the pocket is larger than the fuse clip;

the fuse clip can move rotationally about the nub and within the pocket;

at least one of contact between the opening and the nub and contact between an edge of the fuse clip and an edge of the pocket limits movement of the fuse clip within the pocket; and contact between an edge of the fuse clip and an edge of the pocket limits rotational movement of the fuse clip within the pocket.

15. The fuseblock of claim 14, wherein:

the fuse clip can move laterally within the pocket; and contact between an edge of the fuse clip and an edge of the pocket limits lateral movement of the fuse clip within the pocket.

16. A method for assembling a fuseblock for connecting a fuse to at least one power source, comprising the steps of:

snapping fuse clips into place within a fuse carrier;

snapping a fuse into place within the fuse clips;

inserting at least one flexible locking member of one of the fuse carrier and a fuseblock base shell into matching locking recesses in the other of the fuse carrier and the fuseblock base shell to lock the fuse carrier together with the fuseblock base shell;

inserting at least one power connection assembly into a recess in a fuseblock base bottom; and inserting at least one flexible locking member of one of the fuseblock base bottom and the fuseblock base shell into matching locking recesses in the other of the fuseblock base bottom and the fuseblock base shell to lock the fuseblock base bottom together with the fuseblock base shell and secure the at least one power connection assembly between the fuseblock base shell and the fuseblock base bottom.

17. The method of claim 16, wherein the step of snapping fuse clips into place within a fuse carrier comprises the steps of:

partially surrounding a fuse clip electrode with a fuse clip spring to form a fuse clip;

placing a nub on an inner surface of the fuse carrier through a hole in the fuse clip; and pressing the fuse clip into the fuse carrier until a flange of the fuse clip moves behind a shoulder on the inner surface of the fuse carrier.

18. The method of claim 16, wherein the method further comprises mounting the fuseblock on a mounting rail by performing the steps of:

hooking an edge of the mounting rail behind a fixed integral projection of the fuseblock base shell;

pressing an opposite edge of the mounting rail against a flexible integral projection of the fuseblock base shell until the flexible integral projection deflects and the opposite edge of the mounting rail snaps into place behind the flexible integral projection.

19. The fuseblock of claim 14, wherein the nub is smaller than the opening and the pocket is larger than the fuse clip to allow the fuse clip to move about the nub and within the pocket.

20. The fuseblock of claim 14, wherein the nub and the opening are substantially round.

* * * * *